US007096956B2

(12) United States Patent
Reimert

(10) Patent No.: US 7,096,956 B2
(45) Date of Patent: Aug. 29, 2006

(54) WELLHEAD ASSEMBLY WITH PRESSURE ACTUATED SEAL ASSEMBLY AND RUNNING TOOL

(75) Inventor: Larry Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/863,689

(22) Filed: Jun. 8, 2004

(65) Prior Publication Data

US 2004/0251031 A1 Dec. 16, 2004

Related U.S. Application Data

(60) Provisional application No. 60/476,933, filed on Jun. 10, 2003.

(51) Int. Cl.
*E21B 29/12* (2006.01)

(52) U.S. Cl. ..... 166/348; 166/387; 166/339

(58) Field of Classification Search ..... 166/348, 166/382, 368, 208, 387, 339
See application file for complete search history.

(56) References Cited

U.S. PATENT DOCUMENTS

| | | | | |
|---|---|---|---|---|
| 3,693,714 | A * | 9/1972 | Baugh | 166/348 |
| 4,561,499 | A * | 12/1985 | Berner et al. | 166/341 |
| 4,674,576 | A * | 6/1987 | Goris et al. | 166/382 |
| 4,757,860 | A | 7/1988 | Reimert | |
| 4,766,956 | A * | 8/1988 | Smith et al. | 166/182 |
| 4,969,516 | A | 11/1990 | Henderson et al. | |
| 5,044,442 | A | 9/1991 | Nobileau | |
| 5,372,201 | A | 12/1994 | Milberger | |
| 6,557,638 | B1 * | 5/2003 | Cunningham et al. | 166/348 |

* cited by examiner

*Primary Examiner*—Thomas A Beach
(74) *Attorney, Agent, or Firm*—Browning Bushman P.C.

(57) ABSTRACT

A subsea well assembly includes a wellhead housing 50 having a cylindrical inner sealing surface and a tubular hanger 10 having a tapered external sealing surface. The running tool 30 includes a central stem 40 connected to the running string. A setting piston 72 is responsive to fluid pressure in the annulus about the running string, and has a radially outer surface and a radially inner surface each for sealing with the running tool body. Fluid pressure to set the seal assembly may be applied to the setting piston through an annulus about the running string, and may also act directly on an initially set seal assembly 20.

30 Claims, 5 Drawing Sheets

WELLHEAD ASSEMBLY WITH PRESSURE ACTUATED SEAL ASSEMBLY AND RUNNING TOOL

RELATED CASE

The present application claims the benefit of Application 60/476,933 filed Jun. 10, 2003.

FIELD OF THE INVENTION

The present invention relates to wellhead equipment and, more particularly, to a wellhead assembly with a tubular hanger adapter to be lowered in a well, then landed within and sealed to a subsea wellhead housing, thereby suspending a tubular string from the wellhead housing, with the hanger sealed to the wellhead housing.

BACKGROUND OF THE INVENTION

A wellhead housing may be located on the sea floor, so that a casing string may extend downward from the wellhead housing into the well, with the casing string supported in the wellhead housing by a casing hanger. A seal assembly may be installed between the casing hanger at the upper end of the casing string and the wellhead housing. The operator may install the casing string and seal assembly remotely, and in seas of considerable depths.

Running tools have been developed for delivering forces to set and test the downhole seal assemblies, as disclosed in U.S. Pat. No. 4,969,516. Hydraulic pressure may result in axial movement of a piston within a sealed hydraulic chamber in the running tool. Many hydraulically powered running tools are, however, complex and expensive. U.S. Pat. No. 5,044,442 discloses a hydraulic running tool which utilizes annulus pressure. Rams may be closed around a running string, creating a chamber below the rams. An elastomeric seal may be sealed to a portion of the running tool and to the wellhead. The seal and a collar enable pressure to be applied to stroke the tool. Fluid may be pumped downhole through choke and kill lines to set the casing hanger seal.

Other relevant patents include U.S. Pat. Nos. 4,757,860, 5,372,201, and 5,791,418. The '860 patent discloses a running tool for positioning a seal assembly between a casing hanger and a casing head. A first sleeve is connected to the hanger and a second sleeve is threadably connected to the first sleeve, and is movable between one position to support the seal assembly, and a second position for releasing the seal assembly to be lowered for sealing with the casing hanger. The '201 patent discloses a running tool which includes a pressure set seal, where the setting sleeve is sealed to the wellhead. The '418 patent discloses a tool designed to shift an external valve sleeve in a wellhead housing.

The disadvantage of the prior art are overcome by the present invention, and an improved annulus pressure actuated hanger seal assembly and running tool are hereinafter disclosed.

SUMMARY OF THE INVENTION

In one embodiment, the seal assembly and running tool of this invention may be used to seal a wellhead housing with one or more hangers in a well, with at least one of the hangers supporting a tubular string in the well. The seal assembly may be lowered with the hanger on a running tool so that the seal assembly is spaced above its set position when the hanger is landed in the wellhead. By manipulation of the running tool string, the seal assembly may be lowered to an initial sealing position. A downward force may thus be applied by set down weight acting on the running tool and transmitted to the seal assembly to initially seal between the bore wall in the wellhead housing and the tubular hanger. A setting piston in the running tool seals with the tool body and moves axially in response to fluid pressure in the annulus about the running string to set the seal assembly. The application of fluid pressure energizes the seal assembly, and may also lock the seal assembly into place so that the integrity of the set seal assembly may be tested.

The annular space between wellhead housing and the tubular hanger may be closed by the seal assembly forming a metal-to-metal seal, and optionally a metal-to-metal seal and a resilient or elastomeric seal, with both the wellhead housing and the hanger.

A locking piston may be provided on the running tool for locking the seal assembly to the hanger, with the setting piston having a larger pressure area than the locking piston. The setting piston preferably is radially outward of the locking piston. Fluid below both the setting piston and the locking piston may be vented to the annulus below the hanger.

The seal assembly preferably forms an initial contact seal between the hanger and the wellhead housing for initially setting the seal assembly. The outer surface sealed by the seal assembly may be substantially cylindrical, and a taper provided on the hanger to force the seal assembly outward when pushed down the taper.

In one subsea application, a blowout preventor is positioned above the wellhead housing, and at least one choke and kill line extends from the surface to the blowout preventor to allow pressure to be applied below the BOP. A connector may connect the blowout preventor to the wellhead housing. Fluid pressure may be applied through the choke and kill lines to the setting piston when the blowout preventor rams are closed.

According to the method, a seal assembly is positioned between a wellhead housing and a tubular hanger for supporting a tubular string in a well. The method includes lowering the seal assembly within the wellhead housing on the running tool to an initial sealing position, and increasing fluid pressure to move the setting piston on the running tool axially to a set position, such that the seal assembly is energized by the application of fluid pressure to the setting piston. An elastomeric seal is preferably provided for at least initial sealing between the wellhead housing and the hanger, and a locking piston supported on the running tool is provided for locking the seal assembly to the hanger.

A split lock ring may expand by rotation of the running string to move a setting sleeve to a locked position, while rotation of the running string in an opposing direction moves the setting sleeve to an unlocked position. An anti-rotation key may be provided for allowing a running string to be rotated and the setting sleeve moved axially without rotating either the running tool or the hanger. A retaining ring carried on the setting sleeve may secure the seal assembly in place when the hanger is being run in a well, then release the fully installed seal assembly. Rotation of the running string to the right also releases the seal assembly to move downward.

A running tool is provided for setting a seal assembly between a wellhead housing and a tubular hanger for supporting a tubular string in a well. The running tool includes a running tool body for lowering the seal assembly within wellhead housing, and a setting piston supported on the running tool body for moving the seal assembly axially to a set position, such that the seal assembly may be lowered and energized by the application of fluid pressure to the setting piston. Fluid pressure in the assembly surrounding the running string acts on the setting piston for moving the seal assembly to the set position. The setting piston seals on a radially inward surface and a radially outward surface of the tool body. An elastomeric seal on the seal assembly is preferably also provided for sealing between the wellhead housing and the hanger, and allows fluid pressure to also act directly on the seal assembly. A locking piston supported on the running tool may lock the seal assembly to the hanger.

These and other features and advantages of the present invention will become apparent from the following detailed description, wherein reference is made to the figures in the accompanying drawings.

DETAILED DESCRIPTION OF PREFERRED EMBODIMENTS

Figure 1:
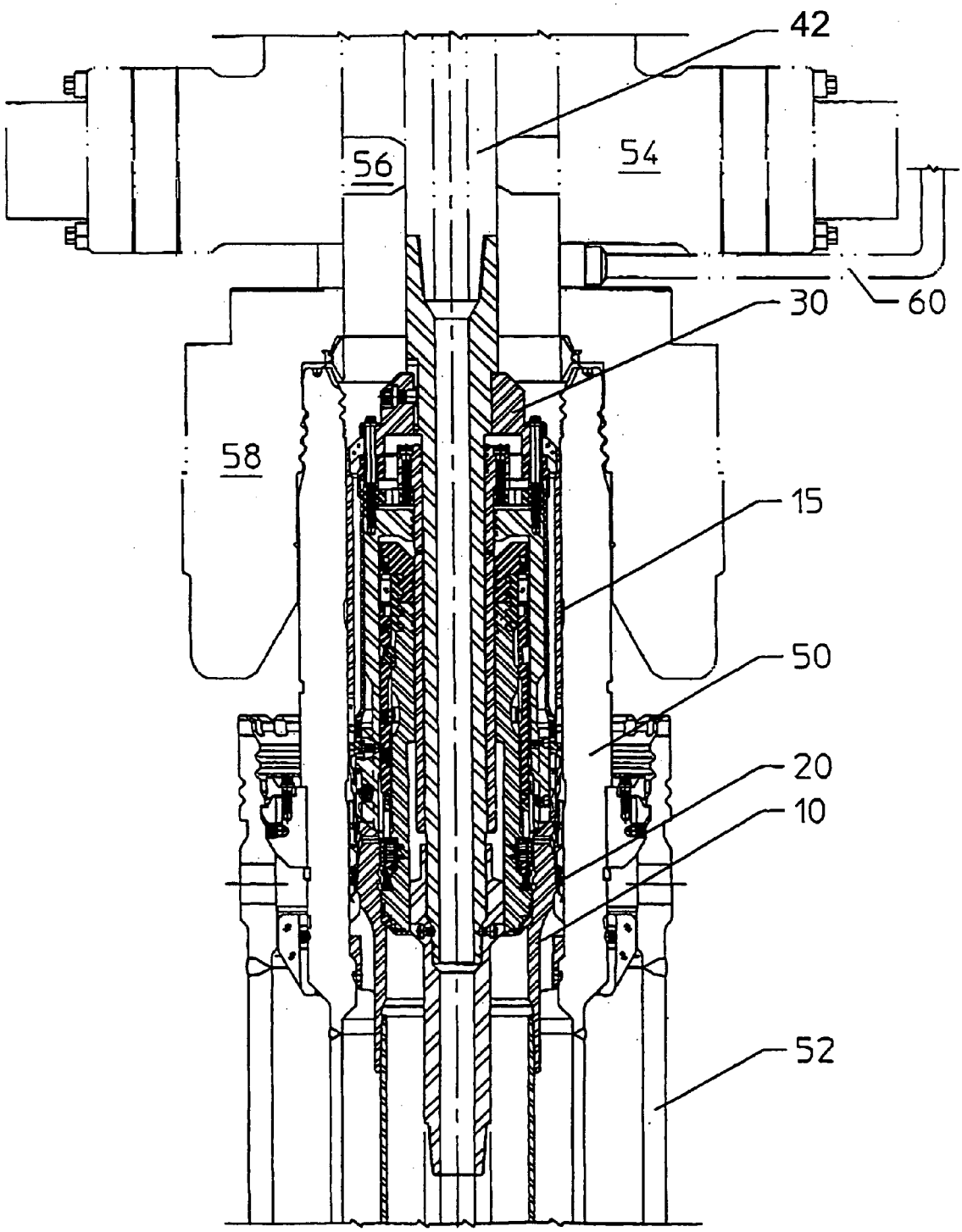
FIG. 1 shows the casing hanger seal assembly landed and fully energized, and locked in place inside the wellhead housing and its relationship to a BOP and a running tool.

FIG. 1 illustrates a subsea wellhead housing 50, an outer conductor pipe 52, a blowout preventor (BOP) 54 above the wellhead with rams 56, and connector 58 connecting the BOP 54 to the wellhead housing 50. A plurality of the choke and kill lines 60 may conventionally extend from the surface to the BOP, and may be used to operate the casing hanger running tool, as disclosed herein. Separate hydraulic lines (not shown) may extend from the surface to power the rams of the BOP.

FIG. 1 shows the casing hanger 10 landed on a subsea wellhead housing 50, with the seal assembly 20 fully set and locked in place. Subsea wellheads and casing hangers are used in increasingly high temperature and/or pressure environments. A preferred all metal seal may accommodate these requirements, but the force required to install the seal is also higher. The present invention provides a setting piston to assist in providing the required setting force to fully set the seal.

The running tool 30 supports the hanger 10 by a split lock ring 32 (see FIG. 2) that may expand and lock the tool to the hanger. The split ring 32 biased radially inward may be expanded by rotation of the running string 42 and thus the running tool central stem 40 to the left, which in turn moves an actuating sleeve 34 to a locked, radially downward position. Conventional rotation of the running string to the right (clockwise looking down) thus releases the hanger from the running tool. When rotating to the right, the actuating sleeve 34 comes out from behind a split lock ring, allowing the biased inward split lock ring 32 to contract radially inward out of the mating grooves 35 in the hanger to release the tool 30 from the hanger 10.

Figure 2:
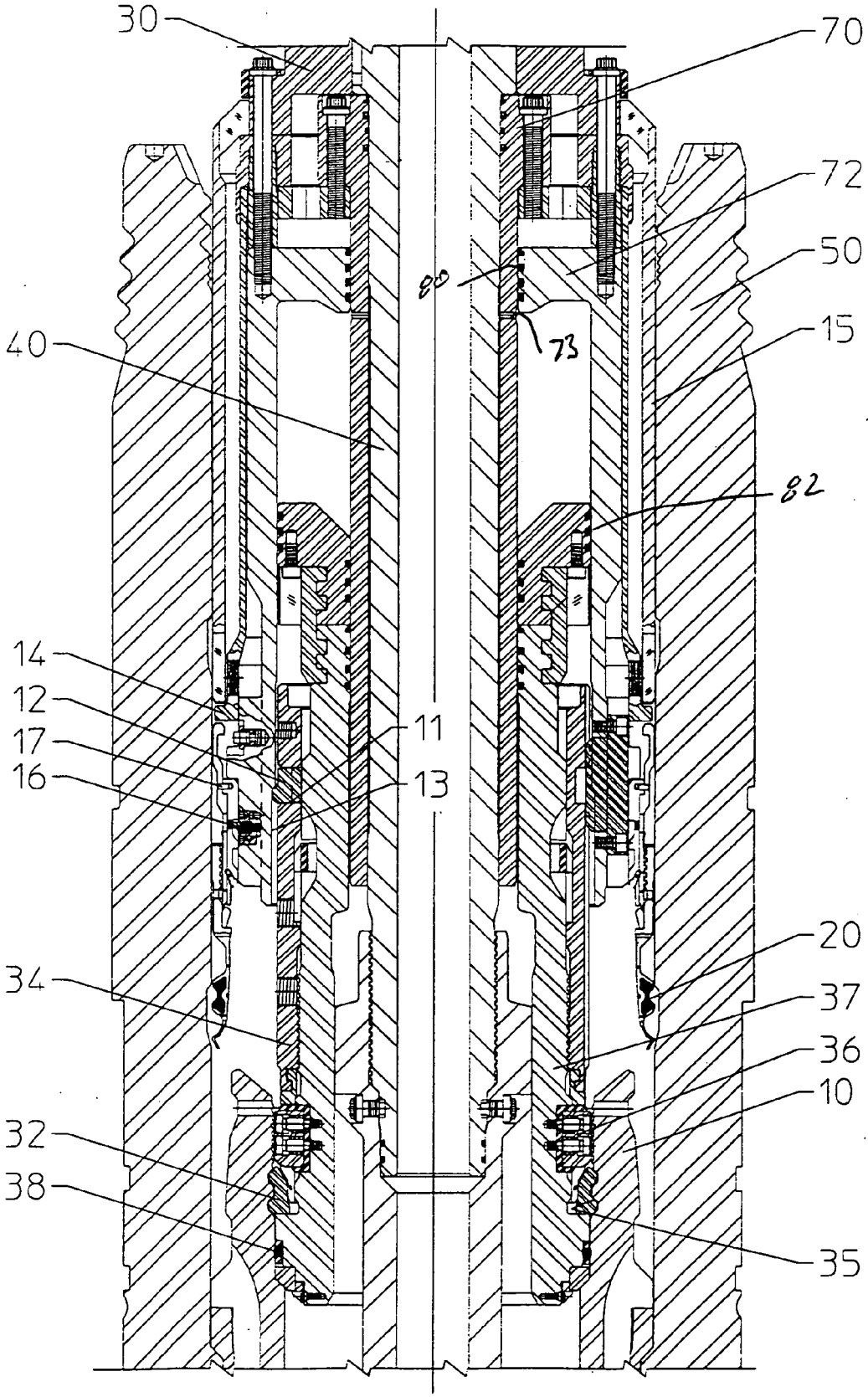
FIG. 2 shows an enlarged view of the hanger in the initial landed position.

One or more rotation keys 36 as shown in FIG. 2 may be located on the lower end of the running tool body 37, and allow the drill pipe or running string 42 and thus the central stem 40 of the running tool connected thereto to be rotated, and the actuating sleeve 34 moved axially without rotation of the tool body 37 or the hanger 10. The seal 38 on the lower end of the body below the anti-rotation key seals the inner casing annulus from the outer casing annulus.

One or more release dogs 12 may each be carried by a window 11 in the actuating sleeve 34, and are moved in response to axial movement of the actuating sleeve 34. The release dogs 12 may be radially expanded to hold the seal assembly 20 in place while the hanger is being run, then release inward to allow the released seal assembly 20 to be moved to the set position. While the tool is locked to the hanger, the release dogs 12 may be in the radially outward position to hold the seal assembly 20 in place.

Once the hanger 10 has been landed, the running string 42 may be rotated to the right to allow the tool to be released from the hanger. While rotating the central stem 40 to the right, the actuating sleeve 34 may be rotated to move to the unlock or up position. While the actuating sleeve is moved to the unlock or up position, the release dogs 12 also move up until they are radially retracted into a groove 13 in the body of the tool. Once the release dogs 12 enter this groove, the lower part of the setting piston 72 releases, and the seal assembly 20 may move downward with the setting piston. The weight of the running string 42 acting on the top of the tool 30 and on the setting piston 72 then pushes the seal assembly 20 to an initial contact seal on the hanger 10 and the bore wall of the wellhead housing 50.

The setting piston 72 may thus move downward with the seal assembly 20 until the seal assembly contacts the hanger, thereby generating a contact seal between the OD of the hanger and the ID of the wellhead housing. This initial seal may be between a rubber or elastomeric portion of the seal assembly and both the hanger 10 and the wellhead housing 50. With the rams 56 of the BOP 54 closed, fluid pressure may be applied through the choke and kill line 60 below the rams. Fluid pressure acting on the setting piston further moves the setting piston downward, with pressure assist from the sealing assembly 20, which is also subject to this fluid pressure. Fluid pressure on the lower face of the piston created during this movement may be vented through port 73 in locking piston 70, then downward to the annulus below the set hanger. During downward movement of locking piston 70, fluid pressure is similarly vented to this annulus. As pressure is applied, the setting piston 72 moves the seal assembly in place. The setting piston 72 applies a substantial setting force to set the seal assembly 20. The set seal assembly 20 preferably forms a metal-to-metal seal with both the wellhead housing 50 and the hanger 10.

Figure 5:
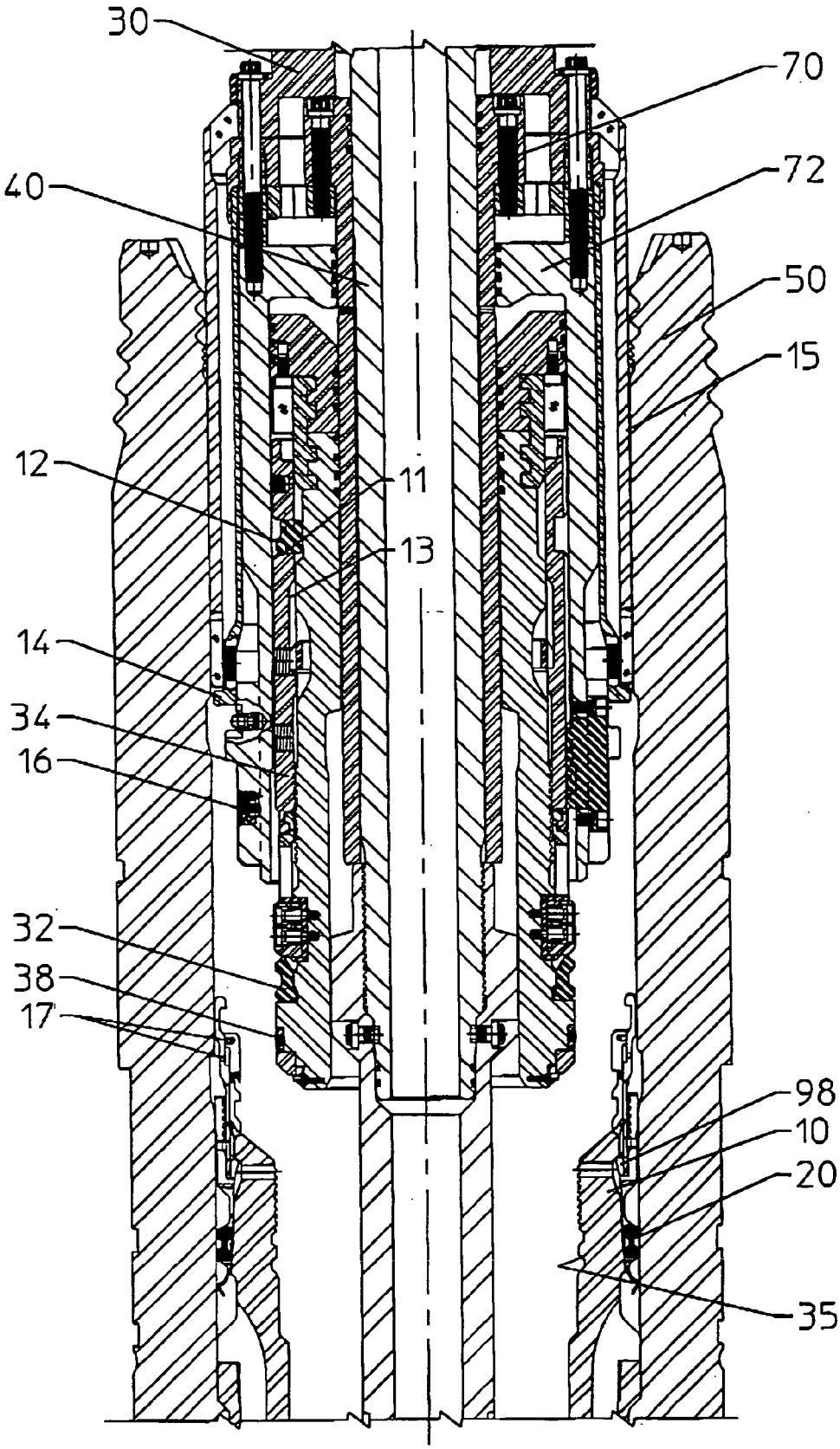
FIG. 5 shows the seal assembly after being locked in place with the running tool being removed.

Once the seal has landed and is sealed to the wellhead housing 50 and the hanger 10, fluid pressure may be increased until the locking sleeve 14 connected to the locking piston 70 locks the seal assembly to the hanger and the seal is tested. Once the seal assembly 20 has been set, the locking piston 70 and the locking sleeve 14 may thus continue to move downward. When shear pins 17 in the seal assembly 20 are sheared, the lock ring 98 as shown in FIG. 5 is forced to move inward into a recess in the upper end of the casing hanger, thereby locking the seal assembly to the hanger. Once the seal assembly has been landed, locked in place and tested, the BOP rams may be opened and a straight pull on the working string 41 used to release the locks 16 and release the tool 30 from the set seal assembly 20.

The surfaces being sealed by the seal assembly of the present invention may be provided in a well below a BOP or other closure device. Pressure from above is supplied to the setting piston 72 to force the seal downward. In a preferred application as disclosed above, an elastomeric member of seal assembly 20 engages the bore of a cylindrical inner wall of the subsea wellhead housing, although the seal could in other applications engage the bore of a surface housing. The hanger 10 has a radially external sealing surface with a taper for forcing the seal assembly radially outward to seal with the wellhead housing. The preferred seal assembly includes both an elastomeric seal which, in a preferred embodiment, initially seals with the wellhead housing, and another radially internal elastomeric seal for gas-tight sealing engagement with the tubular hanger. In some applications, it may not be necessary to provide a second elastomeric seal for sealing with the hanger, since one or more annular bumps on the ID of the seal assembly may form a reliable metal-to-metal seal with the outer surface of the hanger.

Release locks 16 may initially fix the seal assembly 20 to the tool 30, with the seal assembly 20 held in place by one or more shear pins 17. The tool 30 may have two or more pistons and sleeves for installing the seal assembly. A locking piston 70 may be used to lock the seal assembly to the hanger, and a setting piston 72 with a larger area may generate the setting force to assist in the final setting of the seal assembly. In the embodiment shown, locking piston 70 is connected to sleeve 14 which contacts the seal assembly during the final locking operation. The upper end of the locking piston 70 may be connected to a plate which is in engagement with the sleeve 14. This plate includes apertures for allowing axial movement of bolts at the upper end of the setting piston to move relative to the plate. An outer sleeve 15 may surround the inner components of the running tool for protection.

Figure 3:
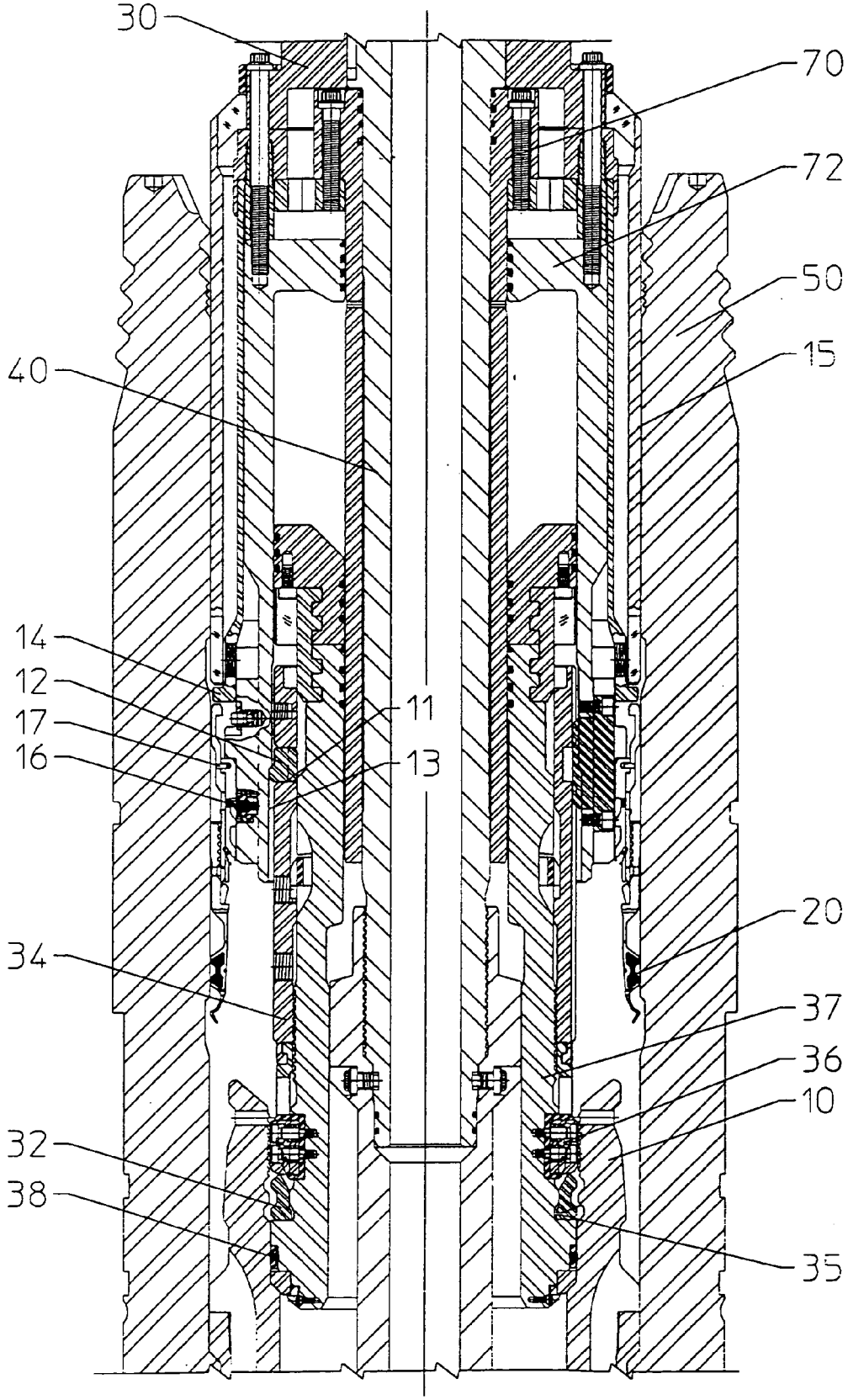
FIG. 3 shows the tool released from the hanger.

FIG. 2 is an enlarged view of the hanger in the initial landed position. The sealing assembly 20 is connected to the lower end of the piston 72, which is retained in the up position. In FIG. 3, the running tool has been released from the hanger, and the setting piston 72 and the seal assembly remain in the up position.

Figure 4:
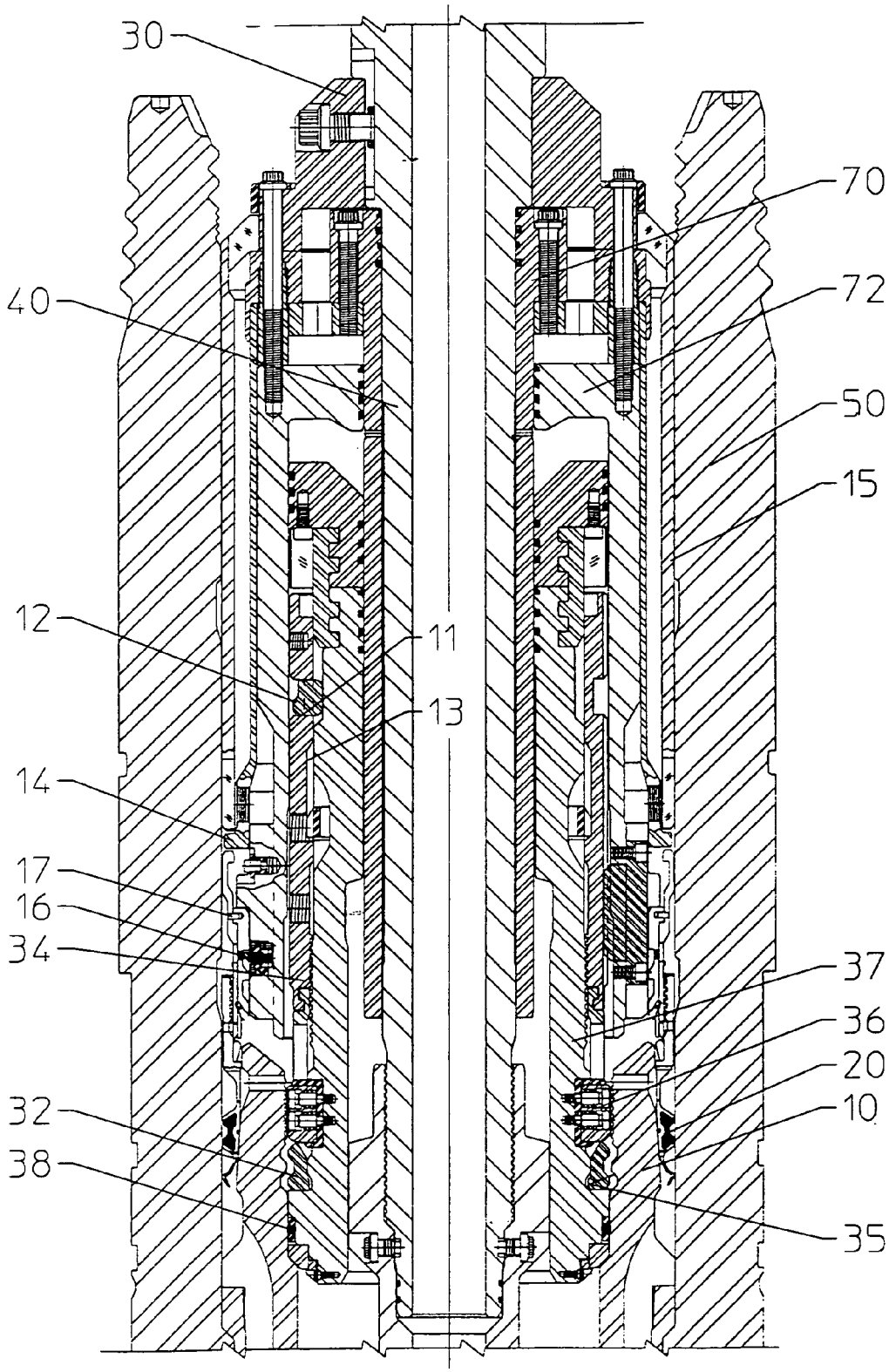
FIG. 4 illustrates a setting sleeve and seal moved downward due to weight set down on the landing string to create an initial contact seal.

FIG. 4 illustrates the setting piston 72 and the seal assembly 20 moved downward. This movement may be caused by axial movement of the running string 41 acting on the top of the tool 30, which may then be transferred as a mechanical force to the top of the setting piston 72 and then to the seal assembly 20.

FIG. 5 illustrates the seal assembly locked in place and the running tool moved upward from the set casing hanger. As shown in FIG. 5, locking key 98, which in FIG. 4 is above the annular recess in the hanger 10, has been moved into the recess to effectively lock the seal assembly 20 in place between the hanger 10 and the wellhead 50.

As disclosed above, the setting piston 72 on the running tool may be actuated to move the seal assembly to the set position. As shown in FIG. 2, setting piston 72 includes one or more radially inward seals 80, which in the disclosed embodiment seal with the OD of the locking piston 70, and one or more radially outward seals 82, which in this embodiment seal with upper extension for the body 37. The piston 72 thus has a radially outward sealing surface and a radially inward sealing surface each for sealing with the running tool body 37 and/or components of the running tool supported on the body, such as locking piston 70. This is a significant feature of the invention, since the setting piston seals do seal with the wellhead and thus not have to compensate for the varying conditions of the inner surface of a wellhead. Also, the design of the present invention allows fluid pressure in the annulus surrounding the working string to act on the seal assembly directly, and this same fluid pressure acts on the piston 72 which mechanically acts on the seal assembly.

Another significant feature of the invention is that this design operates in response to fluid pressure in the annulus about the running tool. This fluid pressure may conventionally be applied subsea through choke and kill lines to the BOP. With the BOP ram closed, fluid pressure may thus be controlled in the annulus about the running tool. By avoiding operation of the tool in response to fluid pressure in the work string and/or the central stem or mandrel of the tool, the cost of balls, seats, plugs or other sealing members passing through or spaced below the running tool are avoided. Also, significant savings are realized in the time savings by the operator to run in and use such sealing devices.

In the embodiment disclosed above, the annular seal assembly seals to the exterior surface of a casing hanger, but in other applications the setting piston may force the seal assembly in an annulus between the wellhead housing and an exterior surface of a tubular, or to a plug member, such as a tree cap or a dummy hanger. A preferred embodiment allows fluid on the back side of both the setting piston and the locking piston to be vented to the area inside the running tool body and below the hanger. As disclosed herein, the setting piston is radially outward of the locking piston, although in an alternate embodiment the locking piston might be provided exterior of the setting piston. A preferred embodiment allows the seal assembly to be locked in place once the setting piston has fully set the seal, although in alternate embodiments the locking piston might be eliminated.

In the above described embodiments, fluid pressure was applied from choke and kill lines to the annulus surrounding the running string and then to the setting piston and seal assembly to set the seal assembly. In other applications, fluid pressure to the setting piston may be supplied through the annulus surrounding the running string from other flow lines extending, for example, from a rig spaced from the subsea well. In this application, the BOP may be located subsea or on the surface.

While preferred embodiments of the present invention have been illustrated in detail, it is apparent that other modifications and adaptations of the preferred embodiments will occur to those skilled in the art. The embodiments shown and described are thus exemplary, and various other modifications to the preferred embodiments may be made which are within the spirit of the invention. Accordingly, it is to be expressly understood that such modifications and adaptations are within the scope of the present invention, which is defined in the following claims.

The invention claimed is:

1. A subsea wellhead assembly including a wellhead housing having a cylindrical inner sealing surface and a tubular hanger having a tapered external sealing surface, the tubular hanger supporting a tubular string in a well, the wellhead assembly further comprising:

a running tool having a central stem connected to a running string for lowering the running tool in the well;

the running tool carrying a seal assembly for positioning the seal assembly within the wellhead assembly between the wellhead housing and the tubular hanger;

a setting piston supported on the running tool for moving the seal assembly axially relative to the tubular hanger to a set position;

fluid pressure supplied to the setting piston through an annulus surrounding the running string; and the setting piston having a radially outer surface and a radially inner surface each for sealing with a running tool body.

2. An assembly as defined in claim 1, wherein set down weight is transmitted from the running string through the running tool to the seal assembly for initially sealing between the wellhead housing and the hanger.

3. An assembly as defined in claim 1, further comprising:

the seal assembly including an elastomeric seal for initial sealing with the wellhead housing.

4. An assembly as defined in claim 3, wherein fluid pressure is supplied through the annulus surrounding the running string to the seal assembly subsequent to initial sealing between the wellhead housing and the hanger to assist the setting piston to move the seal assembly to the set position.

5. An assembly as defined in claim 1, wherein the seal assembly, in the set position, forms a metal-to-metal seal with both the wellhead housing and the hanger.

6. An assembly as defined in claim 1, further comprising:

a locking piston supported on the running tool and moveable in response to fluid pressure in the annulus for locking the seal assembly in the set position, the setting piston having a larger pressure area than the locking piston.

7. An assembly as defined in claim 6, wherein the setting piston is radially outward of the locking piston.

8. An assembly as defined in claim 1, wherein fluid pressure created during activation of the setting piston is vented to an annulus surrounding the central stem and below the tubular hanger.

9. An assembly as defined in claim 1, wherein fluid pressure to the setting piston passes through choke and kill lines when blowout preventer rams are closed and then through the annulus surrounding the running string.

10. An assembly as defined in claim 1, wherein left hand rotation of the running string moves an actuating sleeve toward a locked position and expands a split lock ring to connect the running tool to the hanger.

11. An assembly as defined in claim 10, wherein right hand rotation of the running string moves the actuating sleeve toward an unlocked position.

12. An assembly as defined in claim 10, further comprising:

an anti-rotation key for allowing the running string to be rotated and the actuating sleeve to move axially without rotating either a running tool body or the hanger.

13. An assembly as defined in claim 10, wherein release dogs retain the seal assembly and the setting piston in a run-in position, and right hand rotation of the running string moves the actuating sleeve toward the unlocked position such that the release dogs release the seal assembly and the setting piston to move to the set position.

14. A wellhead assembly including a wellhead housing having a inner sealing surface and a tubular hanger having an external sealing surface, the tubular hanger supporting a tubular string in a well, the wellhead assembly further comprising:

a running tool having a central stem connected to a running string for lowering the running tool in the well;

the running tool carrying a seal assembly including an elastomeric seal for initial sealing with the wellhead housing, the running tool positioning the seal assembly within the wellhead assembly between the wellhead housing and the tubular hanger;

a setting piston supported on the running tool for moving the seal assembly axially relative to the tubular hanger to a set position;

fluid pressure supplied to the setting piston and to the seal assembly through an annulus surrounding the running string; and the setting piston having a radially outer surface and a radially inner surface each for sealing with a running tool body.

15. An assembly as defined in claim 14, wherein set down weight is transmitted from the running string through the running tool to the seal assembly for initial sealing between the wellhead housing and the hanger.

16. An assembly as defined in claim 14, wherein the seal assembly, in the set position, forms a metal-to-metal seal with both the wellhead housing and the hanger.

17. An assembly as defined in claim 14, further comprising:

a locking piston supported on the running tool and moveable in response to fluid pressure in the annulus for locking the seal assembly in the set position.

18. A method of setting a seal assembly between a wellhead housing and a tubular hanger for supporting a tubular string in a well, the method comprising:

lowering the seal assembly within the housing on a running tool having a central stem connected to a running string;

passing fluid pressure through an annulus surrounding the running string;

providing a setting piston on the running tool, the setting piston having a radially outer surface and a radially inner surface each for sealing with a running tool body; and increasing fluid pressure to move the setting piston axially relative to the hanger to move the seal assembly to a set position.

19. A method as defined in claim 18, wherein an annular space between the wellhead housing and the tubular hanger is closed by the seal assembly forming a metal-to-metal seal with both the wellhead housing and the hanger.

20. A method as defined in claim 18, further comprising:

providing a locking piston supported on the running tool and moveable in response to fluid pressure in the annulus for locking the seal assembly to the hanger in the set position.

21. A method as defined in claim 18, wherein a surface on the wellhead housing sealed by the seal assembly is substantially cylindrical, and a taper is provided on the hanger to force a seal assembly outward when pushed down the taper.

22. A method as defined in claim 18, wherein a split lock ring expands by left hand rotation of the running string to move a setting sleeve to a locked position.

23. A method as defined in claim 22, wherein right hand rotation of the running string moves the setting sleeve to an unlocked position.

24. A method as defined in claim 18, wherein fluid pressure to the setting piston passes through choke and kill lines when blowout preventer rams are closed and then through the annulus surrounding the running string.

25. A running tool for setting a seal assembly between a wellhead housing and a tubular hanger for supporting a tubular string in a well, the running tool being operatively responsive to fluid pressure supplied through an annulus surrounding the running string, the running tool further comprising:

the seal assembly including an elastomeric seal for initial sealing with the wellhead housing and movably responsive to fluid pressure in the annulus surrounding the running string;

a setting piston supported on the running tool and movably responsive to fluid pressure in the annulus surrounding the running string for moving the seal assembly axially to a set position, such that the seal assembly is set by the application of fluid pressure to the setting piston and the seal assembly; and the setting piston having a radially outer surface and a radially inner surface each for sealing with a running tool body.

26. A running tool as defined in claim 25, wherein an annular space between the wellhead housing and the tubular hanger is closed by the seal assembly forming a metal-to-metal seal with both the wellhead housing and the hanger.

27. A running tool as defined in claim 25, further comprising:

a locking piston supported on the running tool for locking the seal assembly to the hanger, the setting piston having a larger pressure area than the locking piston.

28. A running tool as defined in claim 25, wherein fluid pressure to the setting piston passes through choke and kill lines when blowout preventer rams are closed and then through the annulus surrounding the running string.

29. A running tool as defined in claim 25, wherein an inner surface on the wellhead housing sealed by the seal assembly is substantially cylindrical, and an outer tapered surface on the hanger forces the seal assembly outward when pushed down the tapered surface.

30. A running tool as defined in claim 25, wherein the running tool includes a split lock ring to lock the running tool to the tubular hanger.

* * * * *